US012122582B1

(12) United States Patent
Minton

(10) Patent No.: US 12,122,582 B1
(45) Date of Patent: Oct. 22, 2024

(54) ONE WAY DEGASSER VALVE WITH WHISTLE

(71) Applicant: Ray W Minton, Newcastle, WA (US)

(72) Inventor: Ray W Minton, Newcastle, WA (US)

( * ) Notice: Subject to any disclaimer, the term of this patent is extended or adjusted under 35 U.S.C. 154(b) by 196 days.

(21) Appl. No.: 17/939,712

(22) Filed: Sep. 7, 2022

Related U.S. Application Data

(60) Provisional application No. 63/241,331, filed on Sep. 7, 2021.

(51) Int. Cl.
*B65D 77/22* (2006.01)

(52) U.S. Cl.
CPC ..... *B65D 77/225* (2013.01)

(58) Field of Classification Search
CPC ..... B65D 77/225
USPC ..... 383/45
See application file for complete search history.

(56) References Cited

U.S. PATENT DOCUMENTS

| | | | | |
|---|---|---|---|---|
| 3,873,735 | A * | 3/1975 | Chalin | B65D 75/58 229/123.1 |
| 6,129,265 | A * | 10/2000 | Perryman | B65D 5/4291 220/705 |
| 6,468,332 | B2 | 10/2002 | Goglio | |
| 10,384,850 | B2 | 8/2019 | Devine | |
| 2007/0090109 | A1 * | 4/2007 | Gustavsson | B65D 77/225 220/203.27 |

FOREIGN PATENT DOCUMENTS

| | | | | |
|---|---|---|---|---|
| KR | 200146603 | Y1 * | 6/1999 | |
| SE | 528522 | C2 * | 12/2006 | B65D 77/225 |
| WO | WO-2005065497 | A1 * | 7/2005 | A47G 19/2266 |

* cited by examiner

*Primary Examiner* — Jes F Pascua
(74) *Attorney, Agent, or Firm* — Plager Schack LLP; Mark Plager; Naomi Mann

(57) ABSTRACT

Disclosed is a packaging system comprising a degasser valve configured to enable one-directional airflow for expressing an aroma of a product within a container to which the valve is attached. In certain embodiments, the degasser valve may comprise an air channel extending from an inner side of the degasser valve to an outer side of the degasser valve, and including a sound element such as a whistle tube configured to produce a sound upon airflow through the valve.

20 Claims, 2 Drawing Sheets

ONE WAY DEGASSER VALVE WITH WHISTLE

RELATED APPLICATION

This application claims benefit to U.S. Provisional Application No. 63/241,331 filed on Sep. 7, 2021, which is incorporated by reference herein in its entirety.

BACKGROUND

The present disclosure relates generally to packaging system for aromatic products.

Consumers of aromatic products, such as spices, herbs, teas, hemp, *cannabis*, organic solvents, and the like, may wish to smell the product prior to purchase. As such, an improved system for purchasing such products is desirable.

SUMMARY

According to various embodiments, disclosed is a packaging system comprising a degasser valve configured to enable one-directional airflow for expressing an aroma of a product within a container to which the valve is attached. In certain embodiments, the degasser valve may comprise an air channel extending from an inner side of the degasser valve to an outer side of the degasser valve, and including a sound element such as a whistle tube configured to produce a sound upon airflow through the valve.

BRIEF DESCRIPTION OF THE FIGURES

The detailed description of some embodiments of the invention will be made below with reference to the accompanying figures, wherein the figures disclose one or more embodiments of the present invention.

DETAILED DESCRIPTION OF CERTAIN EMBODIMENTS

Figure 1:
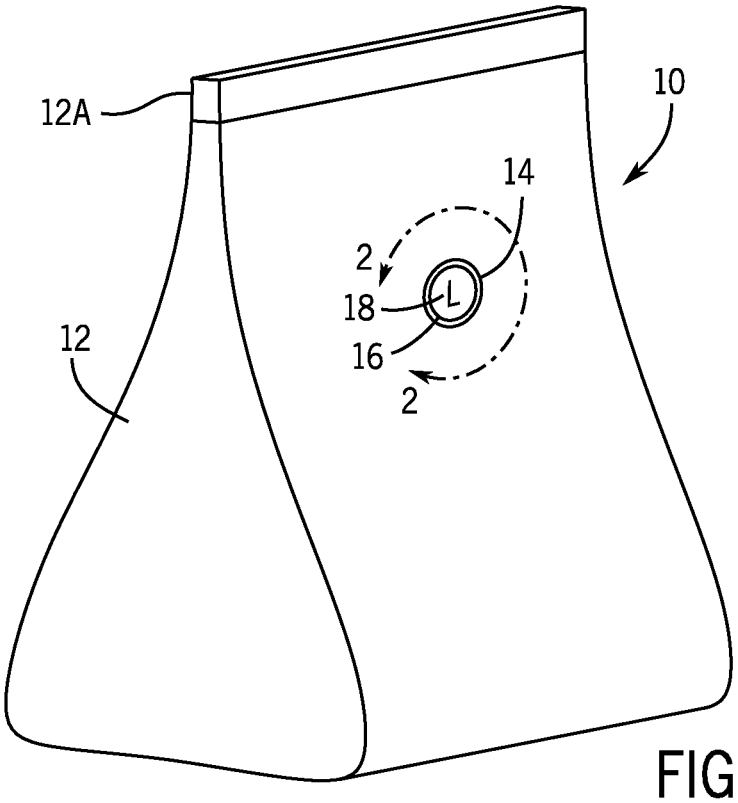
FIG. 1 is a perspective view of a packaging system comprising a one-way degasser valve with whistle incorporated into a bag, according to various embodiments.

According to various embodiments as depicted in FIGS. 1-5, disclosed is a packaging system for aromatic product which incorporates a one-way degasser valve 10 within a squeezable container/bag 12, enabling an aroma of the contents within the bag to be released through the valve upon squeezing of the bag. In some embodiments, valve 10 incorporates a sound element which may be a whistle, for producing a sound effect when the aroma is expressed. As such, a consumer may squeeze the bag to smell its contents with accompanying sound effects. According to various embodiments, the disclosed system may be used for products such as spices, herbs, hemp, *cannabis*, specialty teas, organic solvents, and the like.

In various embodiments, one-way degasser valve 10 may generally comprise an air channel 10A extending from a bottom, i.e., inner side 24 to a top, i.e., outer side 14 of degasser valve 10. When degasser valve 10 is installed to bag 12, outer side 14 of degasser valve 10 is exposed at an outer surface of bag 12 while inner side 24 disposes within bag 12. Degasser valve 10 is generally configured to allow one-directional air to flow from an inner opening 24A of air channel 10A provided on inner side 24 to an outer opening 14A of air channel 10A provided on outer side 14 of the valve. As such, air channel 10A provides a one-directional pathway through which air may be conveyed out of bag 12 when squeezed.

In certain embodiments, one-way degasser valve 10 generally comprises a flapper valve 28 between inner opening 24A and outer opening 14A of air channel 10A. In further embodiments one-way degasser valve 10 may also include a protective membrane 30 disposed across a bottom portion of air channel 10A. Protective member 30 is configured to prevent product contained within bag 12 from obstructing degasser valve 10. In some further embodiments, one-way degasser valve 10 may include a sound element within air channel 10A, which is configured to produce sound upon airflow through the air channel. In some embodiments, the sound element may comprise a constricted channel 20 (also referred to as "top channel 20") forming a top portion of air channel 10A and including an aperture 20A defining outer opening 14A of air channel 10A.

Figure 3:
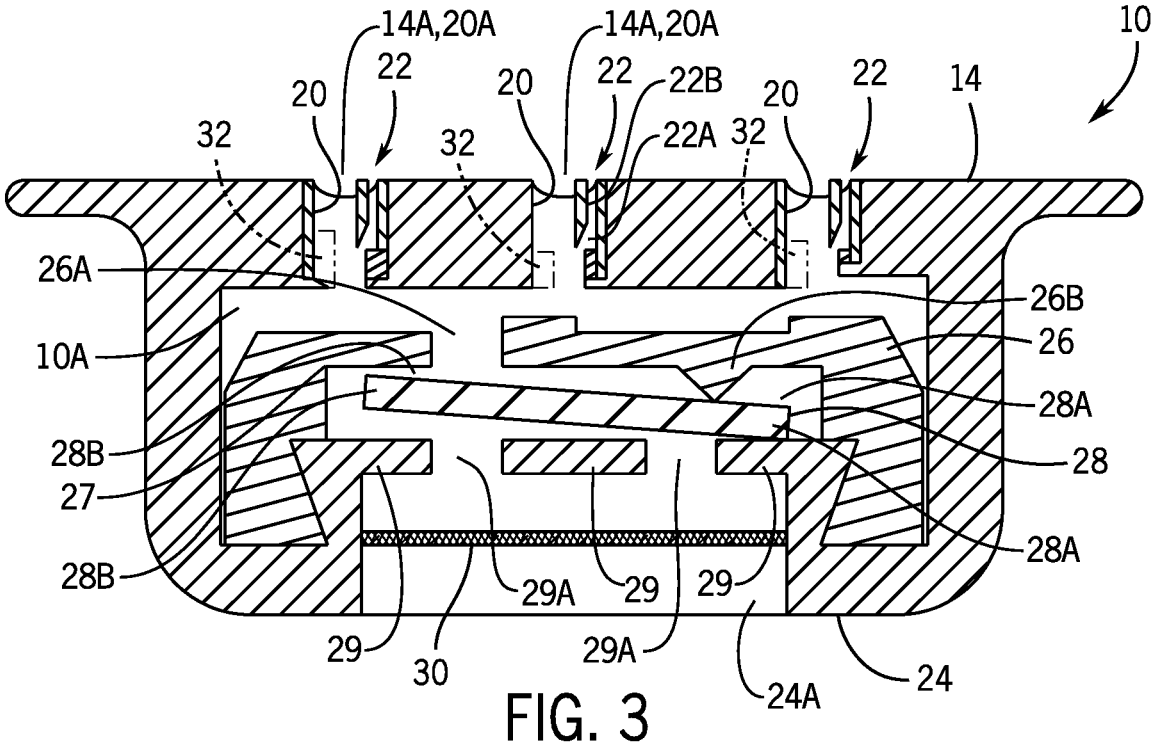
FIG. 3 is a section view taken from line 3-3 of FIG. 2, showing a flapper valve within an intermediate chamber of the degasser valve, the flapper valve shown in an open position for one-directional airflow through the degasser valve.

In certain embodiment, flapper valve 28 is configured to generally block air channel 10A unless sufficient pressure (i.e., pressure exceeding a threshold value) is applied via airflow through air channel 10A from inner opening 24A. Flapper valve 28 is further configured to enable the airflow to exit outer opening 14A, but prevents air from entering the bag through outer opening 14A. In one embodiment as best depicted in FIG. 3, flapper valve 28 may generally be an elongate strip which is retained within an intermediate chamber 27 of degasser valve 10. In embodiments, intermediate chamber 27 may comprise a vented base 29 including at least one base opening(s) 29A; and side and upper surrounding wall(s) 26 including at least one top opening 26A and a flapper valve holder 26B provided above a first end portion 28A opposite a second end portion 28B of flapper valve 28. When at rest, flapper valve 28 blocks base opening(s) 29A. However, when airflow producing sufficient pressure is pushed through inner opening 24A, flapper valve 28 lifts outwards (as depicted in FIG. 3) unblocking opening(s) 29A. In certain embodiments, flapper valve holder 26B impinges on first end portion 28A to hold the flapper valve in place. As such, flapper valve 28 may generally pivot on first end portion 28A, causing rotational displacement of the flapper valve which unblocks openings 29A. This allows for just enough movement to permit airflow to pass. The airflow then passes through top opening 26A to exit intermediate chamber 27. In one embodiment, top opening may provide a gap of about 3 mm. Additionally, flapper valve 28 may be configured to displace about 2-3 mm at its second end. In further embodiments, vented base 29 may include two base openings. In some embodiments, flapper valve 28 is configured to open upon air pressure of between about 2100PA to about 2600PA or greater. In further embodiments, flapper valve 28 is configured to close upon a back pressure of between about 1000PA to about 1300PA, thus preventing reverse airflow through the valve. In some embodiments, flapper valve 28 may comprise a silicone strip. It shall be appreciated that other materials and design configurations for flapper valve 28 and intermediate chamber 27 may be used in alternate embodiments.

Protective membrane 30 is generally configured to prevent product contained within bag 12 from entering intermediate chamber 27 and obstructing valve 10/flapper valve 28. In certain embodiments, protective membrane 30 may be made from a porous fabric which enables airflow into the valve but keeps the contained product out. In some embodiments, protective member 30 may be made from a non-woven fabric such as silicone, polyethylene, polypropylene, polyurethane, polyester, and the like.

In certain embodiments, top channel 20 is generally configured to allow airflow carrying the scent of the substance within bag 12 to flow outwards after exiting intermediate chamber 27. Additionally, top channel 20 may be configured to produce a whistle sound as the air exits. In one embodiment, top channel 20 may comprise a whistle tube 22 and/or various air constricting members 32 configured to create a high-pressure airflow region for producing a whistling effect as airflow is conveyed upwards from intermediate chamber 27. In one embodiment whistle tube 22 may comprise gradually decreasing bottom section 22A and a constricted top section 22B formed by a wall providing a sloped bottom section and a straight top section, as shown in FIG. 3. It shall be appreciated that different structural arrangements and/or sound producing elements may be used to produce various sound effects via airflow in alternate embodiments. Additionally, the sound producing element may be provided at different locations within air channel 10A in alternate embodiments.

Figure 2:
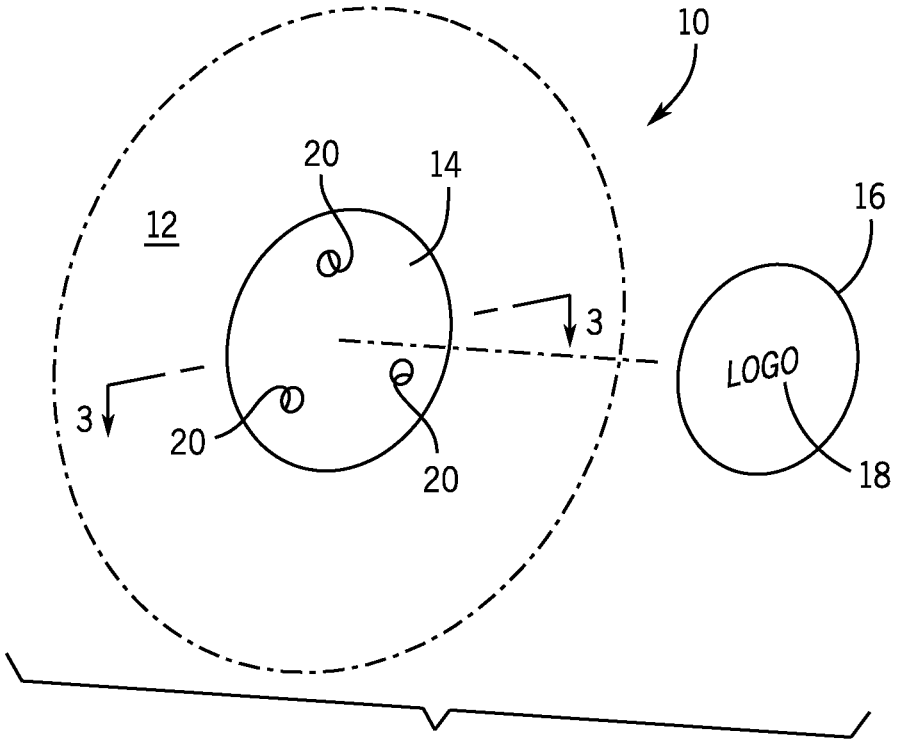
FIG. 2 is an exploded detail perspective view taken from line 2-2 of FIG. 1.
Figure 4:
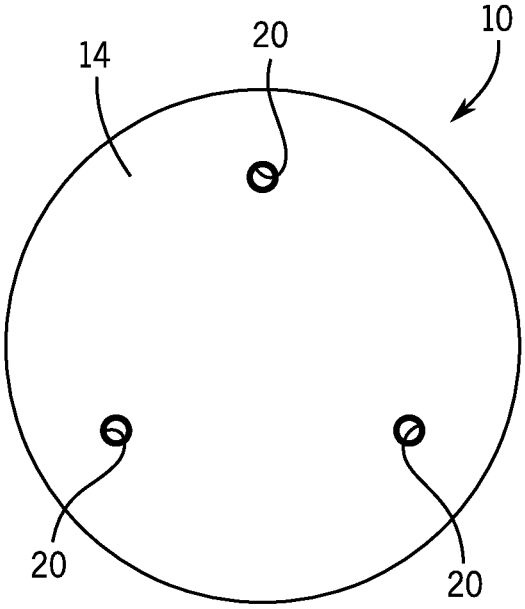
FIG. 4 is a top plan view of the degasser valve.
Figure 5:
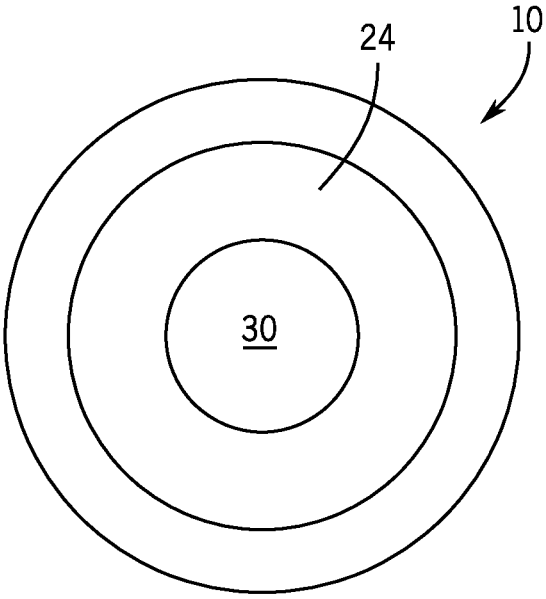
FIG. 5 is a bottom plan view of the degasser valve.

In one embodiment as best depicted in FIGS. 1, 2 and 4, valve 10 may have a low profile circular top end. In some embodiments, valve 10 may be placed approximately at a center of bag 12. In certain embodiments, valve 10 may comprise 3 symmetrically distributed top channels 20/apertures 20A, as shown. It shall be appreciated that valve 10 may have different geometric configurations and/or a different number of apertures in alternate embodiments. In certain embodiments, a sticker 16 may be placed over outer side 14 of one-way degasser valve 10 covering apertures 20A. In some embodiments, sticker 16 may include operational instructions (i.e., to remove the sticker 16 and squeeze the bag) and/or a design such as a brand name or logo 18.

It shall be appreciated that one-way degasser valve 10 may be incorporated into various types of squeezable containers/bags 12, which are generally airtight. In some embodiments, bag 12 may be a Mylar bag with child-proof seal 12A. In some embodiments, bag 12 may be made of a biodegradable material. In further embodiments, bag 12 may be custom designed based on the specific type of product, and/or consumer or seller preferences.

In some embodiments, bag 12 may be filled with an inert gas such as nitrogen, in an amount sufficient to enable the bag to be squeezed multiple times, wherein the amount of inter gas is based on the bag size and/or its contents. In one embodiment, bag 12 may be filled with an amount of inert gas, sufficient to allow for up to about 6 to 10 squeezes, or up to about 9 squeezes. As bag 12 is squeezed the aroma produced by the substance in the bag pushes through protective membrane 30 and flows through vented base 29 to push against flapper valve 28. As the pressure reaches a threshold level (e.g., 2100PA) flapper valve 28 lifts at one end allowing airflow to pass through. The airflow subsequently passes through the whistle tubes 22 to produce a whistle sound as air exits apertures 20A of the valve. As such, a purchaser may squeeze the bag housing degasser valve 10 allowing a small amount of scent to escape, wherein a whistle sound may be produced in the process. The consumer can then smell the product prior to purchase and is left with a memorable purchasing experience. The discloses system may thus increase consumer interest and purchasing incentive along with product sales.

It shall be appreciated that the disclosed degasser valve may be used for various applications, including packaging of various items, such as spices, herbs, hemp, *cannabis*, specialty teas, organic solvents, food items including fresh meats, vegetables, etc.

It shall be appreciated that the disclosed packaging system including degasser valve can have multiple configurations in different embodiments. It shall be appreciated that the components of the packaging system including degasser valve described herein may comprise any alternative known materials in the field and be of any size and/or dimensions. In ne embodiment, degasser valve 10 may be generally made from bioplastic material(s), including renewable biomass sources such as vegetable fats and oils, corn starch, etc., and/or processed natural biopolymers including starch, cellulose, and the like, making the valve fully compostable. It shall be appreciated that the components of the packaging system including degasser valve described herein may be manufactured and assembled using any known techniques in the field. Furthermore, the components of the packaging system may be provided as an assembled and/or integral unit, or may be provided as an assembly of parts according to alternate embodiments.

The constituent elements of the disclosed device and system listed herein are intended to be exemplary only, and it is not intended that this list be used to limit the device of the present application to just these elements. Persons having ordinary skill in the art relevant to the present disclosure may understand there to be equivalent elements that may be substituted within the present disclosure without changing the essential function or operation of the device. Terms such as 'approximate,' 'approximately,' 'about,' etc., as used herein indicate a deviation of within +/−10%. Relationships between the various elements of the disclosed device as described herein are presented as illustrative examples only, and not intended to limit the scope or nature of the relationships between the various elements. Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A packaging system comprising:

a degasser valve comprising:

an air channel extending from an inner side of the degasser valve to an outer side of the degasser valve, the air channel including an inner opening provided on the inner side of the degasser valve, an outer opening provided on the outer side of the degasser valve, and a sound element configured to produce a sound upon airflow through the degasser valve, wherein the degasser valve is configured to allow one-directional airflow from the inner opening to the outer opening; and a flapper valve between the inner opening and the outer opening, the flapper valve being configured to block the air channel absent airflow directed from the inner opening to the outer opening, and to open the air channel upon said airflow directed from the inner opening to the outer opening being at or exceeding a threshold pressure value, the flapper valve further configured to block an airflow directed from the outer opening to the inner opening, wherein the threshold pressure value is between about 2100PA to about 2600PA.

2. The packaging system of claim 1, wherein the sound element comprises a constricted channel configured to produce a whistle sound.

3. The packaging system of claim 2, wherein the constricted channel is provided at a top section of the air channel and includes an aperture defining the outer opening of the air channel.

4. The packaging system of claim 1, further comprising a squeezable container, wherein the degasser valve is attached to the container such that the outer side of the degasser valve is exposed at an outer surface of the container while the inner side of the degasser valve is positioned within the container, and wherein the degasser valve is configured to enable an aroma of a substance within the container to be released through the degasser valve along with a sound upon the container being squeezed.

5. The packaging system of claim 4, further comprising a sticker covering the outer side of the degasser valve, the sticker configured for removal prior to squeezing the container.

6. The packaging system of claim 1, wherein the flapper valve comprises a silicone strip.

7. A packaging system comprising:

a degasser valve comprising:

an air channel extending from an inner side of the degasser valve to an outer side of the degasser valve, the air channel including an inner opening provided on the inner side of the degasser valve, an outer opening provided on the outer side of the degasser valve, and a sound element configured to produce a sound upon airflow through the degasser valve, wherein the degasser valve is configured to allow one-directional airflow from the inner opening to the outer opening; and a flapper valve between the inner opening and the outer opening, the flapper valve being configured to block the air channel absent airflow directed from the inner opening to the outer opening, and to open the air channel upon said airflow directed from the inner opening to the outer opening being at or exceeding a threshold pressure value, the flapper valve further configured to block an airflow directed from the outer opening to the inner opening, the flapper valve comprising an elongate strip which is retained within an intermediate chamber of the degasser valve, wherein the intermediate chamber includes a base having at least one base opening, wherein the elongated strip is configured to lift outwards to unblock the base opening upon said airflow directed from the inner opening to the outer opening being at or exceeding said threshold pressure value, and to otherwise rest on the base to block the base opening.

8. The packaging system of claim 7, wherein the intermediate chamber further comprises surrounding walls including at least one top opening and a flapper valve holder within an upper portion of the surrounding walls, wherein the flapper valve holder is provided above a first end portion opposite a second end portion of the flapper valve, wherein the flapper valve holder is configured to impinge on the first end portion to hold the flapper valve in place when the flapper valve lifts outwards.

9. The packaging system of claim 7, wherein the sound element comprises a constricted channel configured to produce a whistle sound.

10. The packaging system of claim 9, wherein the constricted channel is provided at a top section of the air channel and includes an aperture defining the outer opening of the air channel.

11. The packaging system of claim 7, further comprising a squeezable container, wherein the degasser valve is attached to the container such that the outer side of the degasser valve is exposed at an outer surface of the container while the inner side of the degasser valve is positioned within the container, and wherein the degasser valve is configured to enable an aroma of a substance within the container to be released through the degasser valve along with a sound upon the container being squeezed.

12. The packaging system of claim 11, further comprising a sticker covering the outer side of the degasser valve, the sticker configured for removal prior to squeezing the container.

13. The packaging system of claim 7 wherein the flapper valve comprises a silicone strip.

14. A packaging system comprising:

a degasser valve comprising:

an air channel extending from an inner side of the degasser valve to an outer side of the degasser valve, the air channel including an inner opening provided on the inner side of the degasser valve, an outer opening provided on the outer side of the degasser valve, and a sound element configured to produce a sound upon airflow through the degasser valve, wherein the degasser valve is configured to allow one-directional airflow from the inner opening to the outer opening; and a flapper valve between the inner opening and the outer opening, the flapper valve being configured to block the air channel absent airflow directed from the inner opening to the outer opening, and to open the air channel upon said airflow directed from the inner opening to the outer opening being at or exceeding a threshold pressure value, the flapper valve further configured to block an airflow directed from the outer opening to the inner opening, the degasser valve further comprising a protective membrane disposed across a bottom portion of the air channel, the protective membrane being configured to prevent solid substance from obstructing the flapper valve.

15. The packaging system of claim 14, wherein the protective membrane comprises a non-woven fabric configured to allow airflow therethrough.

16. The packaging system of claim 14, wherein the sound element comprises a constricted channel configured to produce a whistle sound.

17. The packaging system of claim 16, wherein the constricted channel is provided at a top section of the air channel and includes an aperture defining the outer opening of the air channel.

18. The packaging system of claim 14, further comprising a squeezable container, wherein the degasser valve is attached to the container such that the outer side of the degasser valve is exposed at an outer surface of the container while the inner side of the degasser valve is positioned within the container, and wherein the degasser valve is configured to enable an aroma of a substance within the container to be released through the degasser valve along with a sound upon the container being squeezed.

19. The packaging system of claim 18, further comprising a sticker covering the outer side of the degasser valve, the sticker configured for removal prior to squeezing the container.

20. The packaging system of claim 14 wherein the flapper valve comprises a silicone strip.

* * * * *